US007601028B2

(12) United States Patent
Eckel et al.

(10) Patent No.: US 7,601,028 B2
(45) Date of Patent: Oct. 13, 2009

(54) HOUSING AND ELECTRICAL PLUG FOR TRANSMITTING ELECTRICAL DRIVE POWER

(75) Inventors: Markus Eckel, Bürstadt (DE); Wolfgang Maier, Mörfelden-Walldorf (DE); Markus Bahr, Korb (DE); Christoph Kraemer, Weinheim (DE); Josef Woller, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 7 days.

(21) Appl. No.: 11/909,406

(22) PCT Filed: Mar. 21, 2006

(86) PCT No.: PCT/EP2006/002603

§ 371 (c)(1),
(2), (4) Date: Sep. 21, 2007

(87) PCT Pub. No.: WO2006/100045

PCT Pub. Date: Sep. 28, 2006

(65) Prior Publication Data

US 2008/0261458 A1 Oct. 23, 2008

(30) Foreign Application Priority Data

Mar. 24, 2005 (EP) ..... 05006597

(51) Int. Cl.
*H01R 9/05* (2006.01)

(52) U.S. Cl. ..... 439/579; 439/188; 200/51.09

(58) Field of Classification Search ..... 439/578, 439/709, 63, 188
See application file for complete search history.

(56) References Cited

U.S. PATENT DOCUMENTS

| | | | | | |
|---|---|---|---|---|---|
| 3,569,915 | A | * | 3/1971 | Sorensen et al. | 439/608 |
| 3,825,874 | A | * | 7/1974 | Peverill | 439/579 |
| 4,260,966 | A | * | 4/1981 | Boutros | 333/182 |
| 4,362,350 | A | * | 12/1982 | von Harz | 439/608 |
| 4,458,220 | A | * | 7/1984 | Carter et al. | 333/182 |
| 4,494,092 | A | * | 1/1985 | Griffin | 333/182 |
| 4,904,196 | A | * | 2/1990 | Sueyoshi et al. | 439/188 |
| 4,915,649 | A | * | 4/1990 | Shimazu et al. | 439/490 |
| 4,964,814 | A | * | 10/1990 | Tengler et al. | 439/607 |
| 4,990,104 | A | * | 2/1991 | Schieferly | 439/578 |
| 5,055,058 | A | | 10/1991 | Nagasaka et al. | |
| 5,257,949 | A | * | 11/1993 | Paulus | 439/620.1 |

(Continued)

FOREIGN PATENT DOCUMENTS

DE 20205430 U1 7/2002

*Primary Examiner*—Neil Abrams
*Assistant Examiner*—Harshad C Patel
(74) *Attorney, Agent, or Firm*—Barley Snyder LLC

(57) ABSTRACT

A housing for an electrical plug has a plug tip, a cable receiving area adapted to receive a cable, a partition wall between the plug tip and the cable receiving area, a partition opening in the partition wall, and a gap opening in the partition wall. The portion opening extends between the plug tip and the cable receiving area and is adapted to receive an inner conductor element that is electrically connected to a cable inner conductor of the cable. The gap opening extends between the cable receiving area and the plug tip and the gap opening is adapted to receive a shield contact element that projects from the cable receiving area into the plug tip.

19 Claims, 3 Drawing Sheets

U.S. PATENT DOCUMENTS 5,326,285 A * 7/1994 Maros ..... 439/717
5,509,821 A * 4/1996 Small et al. ..... 439/272
5,588,872 A 12/1996 Fukuda
6,386,913 B1 * 5/2002 Mohammad et al. ..... 439/579
6,386,914 B1 * 5/2002 Collins et al. ..... 439/579
6,402,533 B1 * 6/2002 Fan Wong ..... 439/135
7,247,059 B2 * 7/2007 Greaves ..... 439/709
7,416,415 B2 * 8/2008 Hart et al. ..... 439/63
2003/0216072 A1 11/2003 Kato et al.
2004/0038586 A1 * 2/2004 Hall et al. ..... 439/578
2004/0171300 A1 * 9/2004 Brandt et al. ..... 439/579
2008/0014790 A1 * 1/2008 Montena ..... 439/579

* cited by examiner

HOUSING AND ELECTRICAL PLUG FOR TRANSMITTING ELECTRICAL DRIVE POWER

CROSS-REFERENCE TO RELATED APPLICATION DATA

This application claims the benefit of the earlier filed parent international application number PCT/EP2006/002603 having an international filing date of Mar. 21, 2006 that claims the benefit of EP 05 006 597.8 having a filing date of Mar. 24, 2005.

FIELD OF THE INVENTION

The present invention relates to the field of electrical connectors.

BACKGROUND

In electrical engineering and electronics, a large number of plugs and plug receptacles of many different types are known. These serve to transmit electrical power and/or electrical signals with the widest possible range of voltages, currents, frequencies, and data rates. To prevent the emission or coupling-in of electromagnetic interference, plugs and plug receptacles may be provided with single or multiple shielding in accordance with the cables or other transmission elements connected therewith. To protect against damp, dusty, or chemically aggressive environments, plugs and plug receptacles comprise a very wide range of sealing elements. Screw fittings or latch fittings may serve to secure against separation of a plug and a plug receptacle. Due to the extremely wide range of applications and conditions of use, a wide variety of optimized plugs and plug receptacles are available.

A relatively new field of use for plugs and plug receptacles is the transmission of drive power in an electrically driven motor vehicle. This drive power is transmitted between an energy storage means, for example a storage battery, a fuel cell, a generator, or other energy source, a power converter and one or more drive motors in one direction or in both directions, alternately. In particular between the power converter and the drive motor(s), the drive power is transmitted in pulse width-modulated manner and thus with a high AC component. To prevent the emission of electromagnetic interference signals, use is made of cables or leads with shielding.

Motor vehicles with an electromotive drive existed until recently only in the form of prototypes or short run models. For this reason, the plugs and plug receptacles which have been used in the power transmission area are those which are readily available but are distinguished for the most part by a robust but also very complex structure. These plugs and plug receptacles are therefore complex and expensive to produce and fit.

With electrically driven motor vehicles moving into the realms of series and mass production, the demands placed on the plugs and plug receptacles in the power transmission area are also changing. They not only have to be robust and ensure long-term, malfunction-free functioning over the entire life of the motor vehicle, but also have to be simple and cheap to produce and fit.

SUMMARY

A housing for an electrical plug has a plug tip, a cable receiving area adapted to receive a cable, a partition wall between the plug tip and the cable receiving area, a partition opening in the partition wall, and a gap opening in the partition wall. The portion opening extends between the plug tip and the cable receiving area and is adapted to receive an inner conductor element that is electrically connected to a cable inner conductor of the cable. The gap opening extends between the cable receiving area and the plug tip and the gap opening is adapted to receive a shield contact element that projects from the cable receiving area into the plug tip.

BRIEF DESCRIPTION OF THE DRAWINGS

Embodiments of the present invention are explained below with reference to the attached Figures, in which.

DETAILED DESCRIPTION OF THE EMBODIMENT(S)

For the purposes of the present patent application, an electrical plug and an electrical plug receptacle are electrical components which are intended, on the one hand, to be firmly or permanently connected to a cable, and on the other hand, to form a detachable plug-and-socket connection with a mating component. Here, the mating component of the plug is termed plug receptacle and the mating component of the plug receptacle is termed plug. The terminology, plug and plug receptacle, are used below irrespective of male or female configuration, i.e. irrespective of configuration of the contact elements as pins or sockets.

Figure 1:
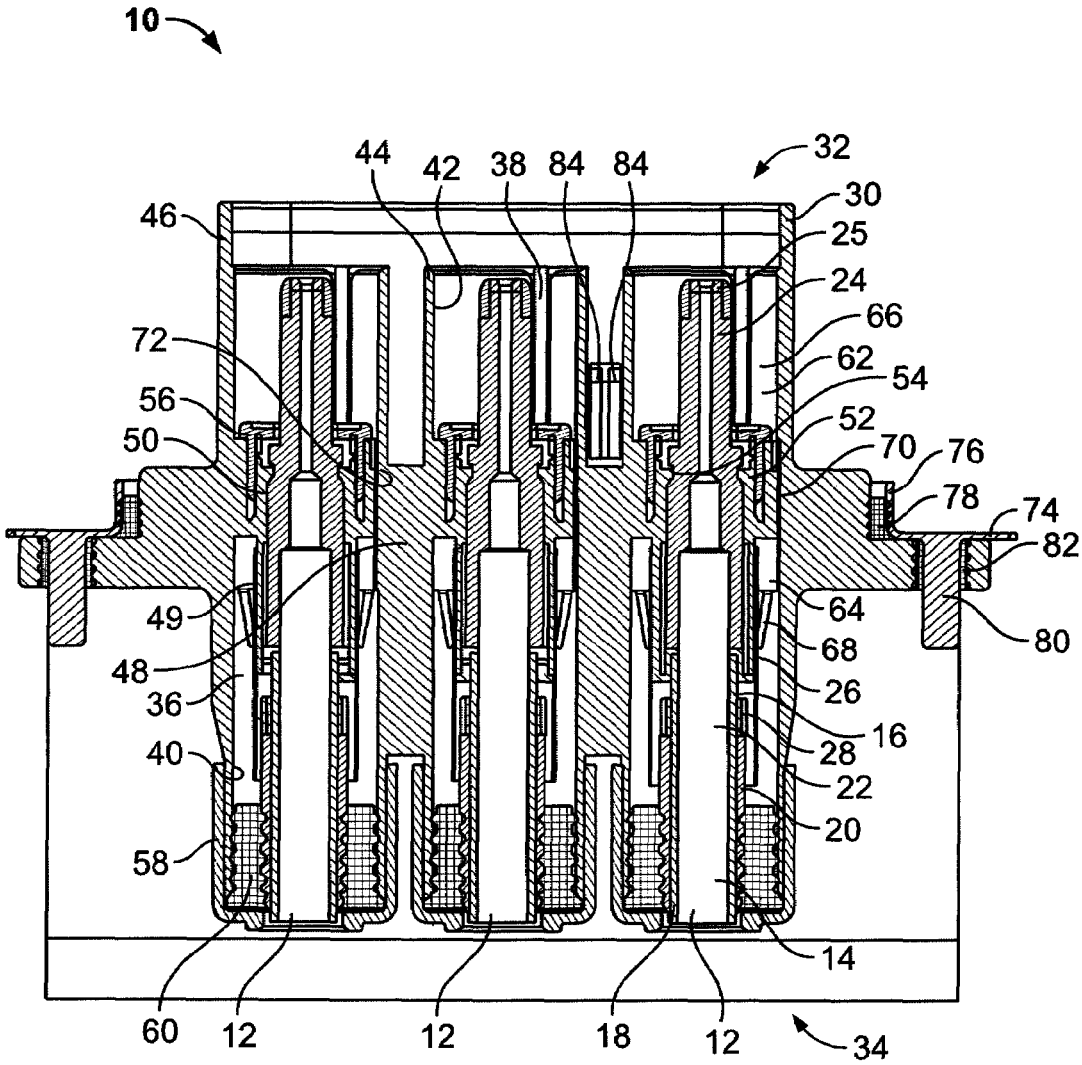
FIG. 1 is a schematic sectional representation of a plug according to the present invention.

FIG. 1 is a schematic representation of a section through a plug 10 for connecting three cables 12 with a plug receptacle (not illustrated). The axes of symmetry of the cables 12 lie in the section plane illustrated. Each cable 12 comprises an inner conductor 14, insulation 16 surrounding the inner conductor 14 in the manner of a jacket or tube, and a shield 18. The shield 18 consists, for example, of a tube-shaped wire mesh, which is insulated electrically from the inner conductor 14 by the insulation 16. Outside the insulation 16, each cable 12 additionally comprises an outer insulating jacket 20, which serves as electrical insulation and to protect against environmental influences.

At the end of each cable 12 connected to the plug 10, the insulation 16, the shield 18, and the insulating jacket 20 are removed, thereby exposing exposed ends 22 of the inner conductors 14. An inner conductor element 24 is crimped onto the exposed end 22 of each inner conductor 14. A shield tube 26 is crimped onto the shield 18, wherein the shield 18, which originally projects beyond the insulating jacket 20, is folded outwards and back over an inner crimp tube 28 and the insulating jacket 20.

In order to prevent injury from an electric shock if fingers touch the inner conductor elements 24, each inner conductor element 24 comprises a finger protector 25 constructed from an electrically insulating material, which at the very least, makes it difficult to touch a live surface of an inner conductor element 24 with a finger.

The plug 10 comprises a one-piece housing 30 produced by injection molding plastic. The housing 30 comprises a plug tip 32 shown at the top in FIG. 1, with which the plug 10 may be connected with a plug receptacle, and a cable receiving area 34 shown at the bottom in FIG. 1, in which the cables 12 are introduced into the housing 30.

The plug-in direction, in which the plug 10 may be connected with a plug receptacle with the plug tip 32, and the direction in which the cables 12 are introduced into the cable receiving area 34 of the plug 10 coincide, in this embodiment, with the direction of the axes of symmetry of the cables 12.

In the cable receiving area 34, the housing 30 comprises a cylindrical and circular-cylindrical cable recess 36 for each of the three cables 12, in which cable recess 36 the cable 12 connected with the plug 10 is concentrically arranged. In the plug tip 32, the housing 30 comprises three recesses 38. Each recess 38 in the plug tip 32 is aligned with one of the cable recesses 36 of the cable receiving area 34. This means in particular that the cable recesses 36 and tip recesses 38 exhibit the same cross-sections in the plug tip 32 and in the cable receiving area 34. Further, the cable receiving area wall 40 of each cable recess 36 in the cable receiving area 34 is aligned with the plug tip wall 42 of the corresponding tip recess 38 in the plug tip 32. In the present embodiment, each tip recess 38 in the plug tip 32 is formed by a cylindrical and circular-cylindrical cup 44. Each inner conductor element 24 is arranged concentrically or coaxially with one of the tip recesses 38 of the plug tip 32. The cups 44 are arranged inside a cup-shaped wall 46, which orally or elliptically surrounds all three cups 44 and protects the inside of the plug 10, particularly the plug-in contacts between the plug 10 and the plug receptacle, against environmental influences. The edge at least of the cup-shaped wall 46 also serves as a sealing face for sealing the connection between the plug 10 and the plug receptacle connected therewith.

Between the plug tip 32 and the cable receiving area 34, and thus also between each cable recess 36 in the cable receiving area 34 and the corresponding tip recess 38 in the plug tip 32, there is arranged a partition wall 48. This partition wall 48, which is arranged horizontally in FIG. 1, comprises a row of partition openings 50, through which the section plane of FIG. 1 passes. In particular, the partition wall 48 comprises three partition openings 50, which are each centered relative to a cable recess 36 in the cable receiving area 34 and to the corresponding tip recess 38 in the plug tip 32.

A tubular or circular-cylindrical insulating sleeve 49 projects from the partition wall 48 coaxially into each cable recess 36 of the cable receiving area 34. When the cable 12 is fitted, said insulating sleeve 49 is located between the inner conductor element 24 (crimped onto the inner conductor 14 of the cable 12) and the shield tube 26 (crimped onto the shield 18) and ensures mutual electrical isolation thereof.

Each inner conductor element 24 projects through one of the partition openings 50 from the cable receiving area 34, in which it is crimped onto the exposed end 22 of the inner conductor 24 of a cable 12, as far as into the plug tip 32. In this case, each inner conductor element 24 lies flat against the inner wall of the corresponding partition opening 50 or is held by a resulting interference-fit. Partition catch elements 52, which are constructed as resiliently movable portions within the partition wall 48, engage in a corresponding circumferential element groove 54 in each inner conductor element 24 and hold the inner conductor element 24 at the described location, illustrated in FIG. 1.

For each inner conductor element 24 or each tip recess 38, a securing element 56 is provided in the plug tip 32, which securing element 56 is inserted into the plug tip 32 only after insertion of the inner conductor element 24 into the housing 30. Each securing element 56 surrounds an inner conductor element 24 substantially in the manner of a ring and engages in such a way in a recess in the partition wall 48 that the partition catch elements 52 can no longer be deflected out of a position in which they engage in the element groove 54 of the inner conductor element 24. The securing element 56 thus locks the inner conductor element 24 in latched engagement in the housing 30.

A cable cap 58 and a cable seal 60 on each cable 12 terminate the housing 30 in the cable receiving area 34 and prevent the ingress of dust, moisture, or aggressive media along the cables 12 into the cable receiving area 32. The cable seal 60 consists of a resilient material that applies itself at least along a plurality of circumferential sealing lines against the insulating jacket 20 and against the cable receiving area wall 40 of the corresponding cable recess 36 in the cable receiving area 34. The cable cap 58 is held on the housing 30 by catch elements (not shown). The cable seal 60 and the cable cap 58 are pulled over the inner conductor element 24 and the shield tube 26 before they are fitted to the cable 12.

Associated with each cable 12 is a shield contact element 62, which comprises a first portion 64 in the cable receiving area 34 and one or more second portions 66 in the plug tip 32. The first portion 64 of each shield contact element 62 is substantially cylindrical and rests against the cable receiving area wall 40 of the corresponding cable recess 36 in the cable receiving area 34 of the housing 30. In addition, each shield contact element 62 comprises one or more contact springs 68, which rest against the corresponding shield tube 26 and thereby produce an electrically conductive connection between the shield 18 of the cable 12 or the shield tube 26 on the one hand, and the shield contact element 62 on the other hand.

Each shield contact element 62 is of one piece construction and inserted from the cable receiving area 34 into a cable recess 36 in the housing 30. The partition wall 48 in each case comprises one or more gap openings 70 between corresponding cable recesses 36 and tip recesses 38 in the cable receiving area 34 and in the plug tip 32. These gap openings 70 are arranged along the edges of the partition wall 48 or along the edges of the portions of the partition wall 48 adjoining the cable recesses 36 and tip recesses 38. In other words, each gap opening 70 is aligned with the cable receiving area walls 40 and plug tip walls 42 of the adjoining cable recesses 36 and tip recesses 38 in the cable receiving area 34 and in the plug tip 32. The second portion or portions 66 of each shield contact element 62 project in the manner of lugs or tongues through the gap openings 70 into the plug tip 32. When the shield contact element 62 has been pushed completely into the housing 30, it is held there by one or more shield contact retention elements 72.

The partition wall 48 comprises three circular arc-shaped gap openings 70 in the area of each cable recess 36 or tip recess 38. In this embodiment, each gap opening 70 covers an angle of approximately 105° relative to the axis of symmetry of the cable receiving area walls 40 and plug tip walls 42 (assumed in this embodiment to be circular-cylindrical) of the cable recesses 36 and tip recesses 38. A web 94 remains between two neighboring gap openings 70 and covers an angle of approximately 15°. The shield contact element 62 is likewise substantially circular-cylindrical, wherein three rectangular slots (each approximately 15° in width) separate three lug or tongue-shaped second portions 66 (each approximately 105° in width) from one another. The shield contact element 62 further deviates from the circular-cylindrical as a result of the contact springs 68, which are formed of inwardly bent strip-shaped portions of the shield contact element 62. Alternately, contact springs 68 may be formed integrally with the crimp tube 28.

An advantage of this construction is that the plug 10 consists of very few individual parts, wherein each shield contact element 62 is simply inserted into the cable recess 36 from the cable receiving area 34 on assembly and pushed with its second portions 66 through the gap openings 70 into the portions 38 on the plug-in side 32. Apart from the contact springs 68, the shield contact element 62 lies with its entire surface against the cable receiving area walls 40 and plug tip walls 42 of the cable recesses 36 and tip recesses 38 in the cable receiving area 34 and shield insertion area 32. The second portions 66 of the shield contact element 62 in particular, which are contacted by corresponding contact elements on connection of the plug 10 with a plug receptacle, are thus supported externally by the cable receiving area walls 40 and plug tip walls 42 and have to exhibit only a low level of inherent mechanical stability. In addition, as a result of this design, the geometry of the plug 10 is determined substantially by a single structural element, namely the housing 30, and cannot be impaired by incorrect adjustment of different structural elements relative to one another.

In addition to the plug 10, FIG. 1 also shows a portion of a bottom plate 74, in particular of an underbody of a motor vehicle. The plug 10 is inserted into an opening in the bottom plate 74 which is defined by an edge 76 of the bottom plate 74 bent by 90°. A plate seal 78 is inserted between this edge 76 of the bottom plate 74 and the housing 30. Near the edge 76 there are arranged studs 80 or other fastening means, which engage through stud openings 82 in the housing 30 and serve to fasten the plug 10 to the bottom plate 74.

Figure 2:
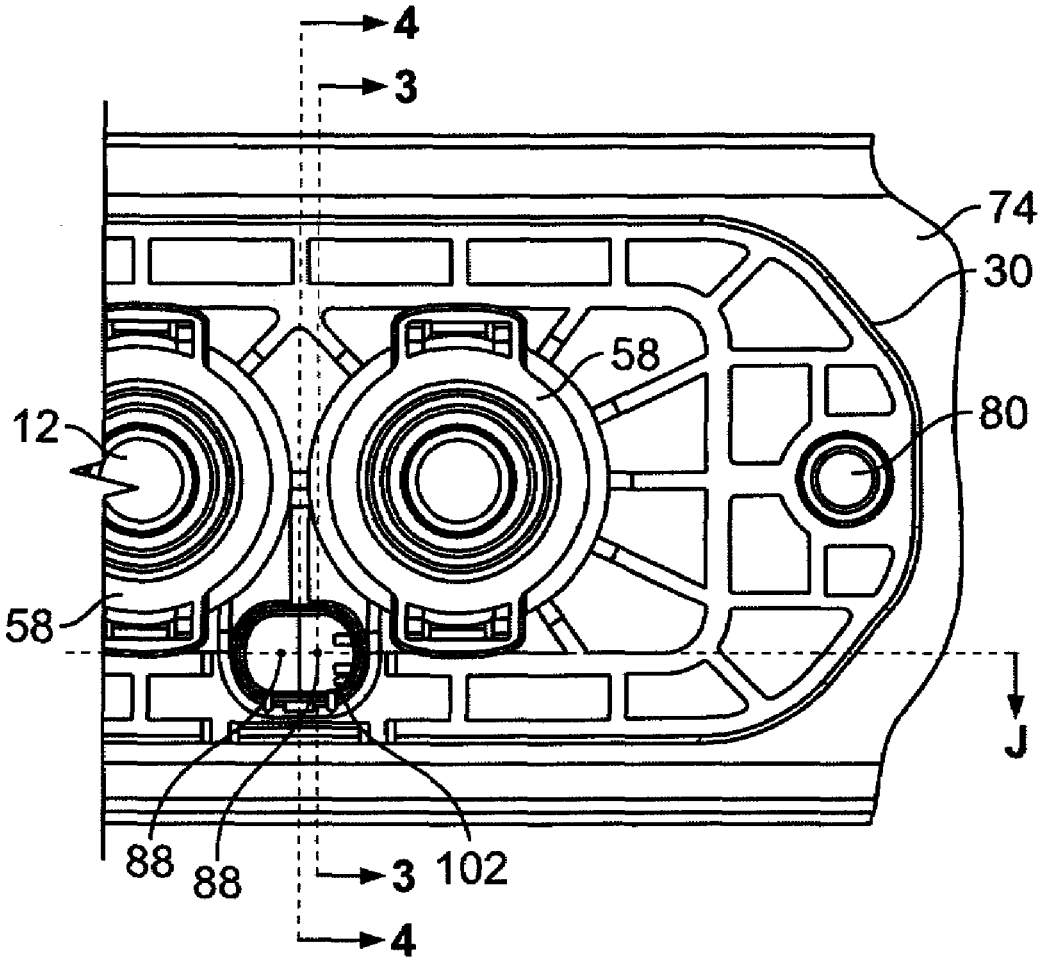
FIG. 2 is a schematic plan view of the plug of FIG. 1.

FIG. 2 is a schematic plan view of the plug 10 illustrated in FIG. 1 and in particular of the cable receiving area 34 thereof in a direction parallel to the cables 12 or the axes of symmetry thereof. In addition to the housing 30, a portion of the bottom plate 74 is also illustrated, into which the plug 10 is inserted. Also visible are two of the cable caps 58 and the cross-sections of the cables 12 and an axial plan view of screw threads for receiving studs 80.

Figure 3:
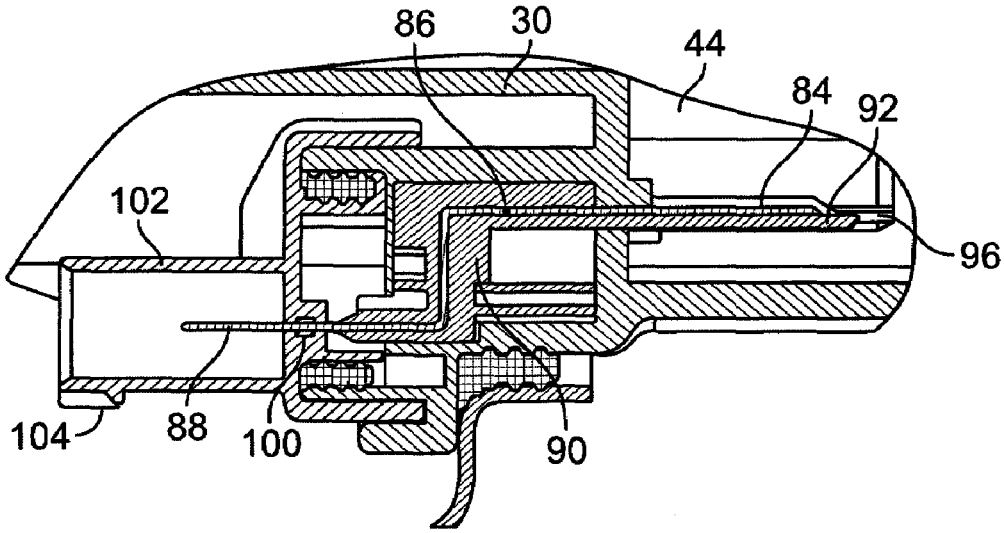
FIG. 3 is a schematic sectional representation of a portion of the plug of FIG. 1.
Figure 4:
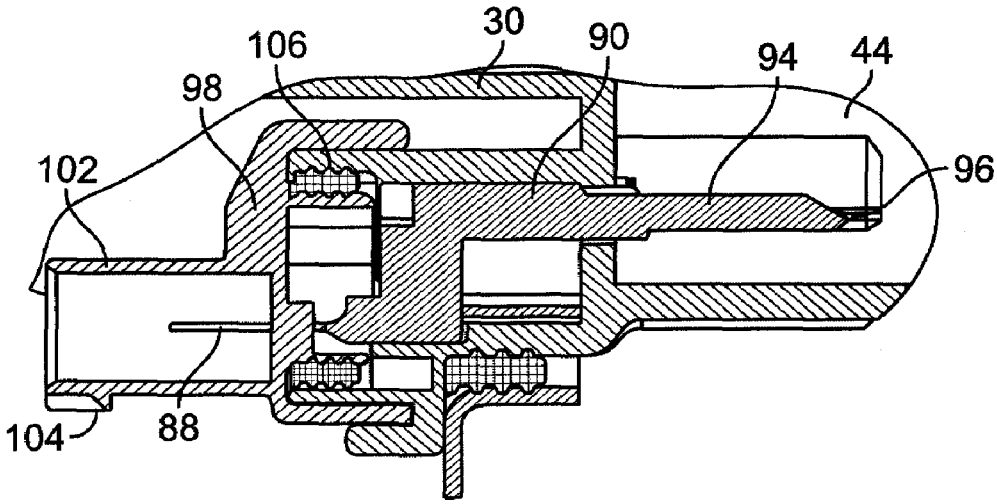
FIG. 4 is a schematic sectional representation of another portion of the plug of FIG. 1.

FIG. 2 also shows parts of an interlock means, which are shown in FIGS. 3 and 4 in two section planes L-L and K-K perpendicular to the section plane of FIG. 1 and to the drawing plane of FIG. 2. This interlock means comprises two strip-form contacts 84, arranged parallel to one another and also visible in FIG. 1, which are arranged outside the tip recesses 38 but inside the cup-shaped wall 46 in the plug tip 32.

The strip-form contacts 84 are the ends of Z-shaped sheet metal strips 86, the opposite ends of which each take the form of a pin 88. The central portions of the sheet metal strips 86 are embedded in a common injection-molded plastic sheath 90, which is inserted into the housing 30. The strip-form contacts 84 lie against a tongue-shaped portion 92 of the injection-molded plastic sheath 90, which portion projects parallel to the plug-in direction into the plug tip 32 of the plug 10. Between the strip-form contacts 84, the tongue-shaped portion 92 comprises a web 94 that reinforces the tongue-shaped portion 92. The edges of the tongue-shaped portion 92 parallel to the plug-in direction are guided in cup grooves 96 that are formed at the outsides of two adjacent cups 44.

Alternatively, the sheet metal strips 86 are injection molded directly into the housing 30 without the injection-molded plastic sheath 90 or are inserted subsequently therein.

The pins 88 project out of the housing 30 on the opposing side next to the cable receiving area 34. Once the injection-molded plastic sheath 90 has been inserted with the embedded sheet metal strips 86 into the housing 30 from the side comprising the cable receiving area 34, a pin cap 98 is pulled on over this portion of the housing 30. This pin cap 98 is held on the housing 30 by catch elements (not shown) and secures the injection-molded plastic sheath 90 with the sheet metal strips 86 in the housing 30. The pins 88 project through holes 100 in the pin cap 98 into a cable connection area, in which a signal cable may be connected to the pins 88. This cable connection area is primarily formed by a cylindrical shell 102 with oval cross-section, that is constructed in one piece with the pin cap 98 and surrounds the pins 88. A catch element 104 is provided on the cylindrical shell 102 to fasten the signal cable to the pin cap 98. Between the pin cap 98 and the housing 30, there is arranged a pin seal 106 for preventing the ingress of dust, liquids, and/or gases into the plug 10.

On connecting the plug 10 with a corresponding plug receptacle, the strip-form contacts 84 are short-circuited by a short-circuit means. The short-circuit means and the strip-form contacts 84 are arranged in such a way that the strip-form contacts 84 are only short-circuited when the inner conductor elements 24 and the shield contact elements 62 are in extensive contact and electrically conductive connection with corresponding elements of the plug receptacles. When plug 10 and plug receptacle are separated, the short circuit between the strip-form contacts 84 is cancelled before separation of the electrically conductive connection between the inner conductor elements 24 and the shield contact elements 62 on the one hand, and the corresponding elements of the plug receptacle on the other hand. This means that the short-circuit means only short circuits the strip-form contacts 84 when the plug 10 and the plug receptacle are connected together at least approximately in the intended manner.

The strip-form contacts 84 are connected via the pins 88 and the above-mentioned signal cable to a control means that controls the transmission of electrical power via the cable 12. This control means interrupts the transmission of electrical power when the strip-form contacts 84 are not short-circuited. In this way, it is ensured that, on the one hand, no arcing occurs between the inner conductor elements 24 and corresponding elements of a plug receptacle on separation of the plug 10 from a plug receptacle, thereby preventing damage to the plug 10 and plug receptacle. It is additionally ensured that no voltages are present at the plug 10 (or exposed contacts of the plug 10) when the latter is not connected with a plug receptacle. In this way, potentially fatal risks are avoided during handling of the plug 10.

Such protective means were hitherto only provided on plugs or plug receptacles that were firmly attached in or on a power supply housing. The present invention also makes such protection possible for the first time in the case of so-called "free-hanging couplings", i.e. plugs and plug receptacles which are connected as separate components to further means via cables.

The above-described housing 30 and electrical plug 10 make possible simple and economic production of the plug 10 and reliable operation of the plug 10.

Although the present invention was illustrated with reference to a plug for three cables 12, it may advantageously be used for plugs with a single cable or any desired plurality of cables. In addition, the inner conductor elements 24 of a plug according to the invention may take the form of sockets instead of pins, or have any other form. The plug 10 illustrated may be used particularly advantageously for the transmission of electrical drive power in a motor vehicle between the cables 12 and a plug receptacle. For example, the plug may connect three parallel cables with a plug receptacle for transmitting three phase alternating current. Furthermore, the plug 10 according to the invention is also advantageous for other applications for which a simple and reliable connector is needed.

The invention claimed is:

1. A housing for an electrical plug, comprising:

a plug tip;

a cable receiving area adapted to receive a cable;

a partition wall between the plug tip and the cable receiving area;

a partition opening in the partition wall extending between the plug tip and the cable receiving area and adapted to receive an inner conductor element that is electrically connected to a cable inner conductor of the cable; and a gap opening in the partition wall extending between the cable receiving area and the plug tip, the gap opening being adapted to receive a shield contact element such that it extends from the cable receiving area into the plug tip, to form an electrical connection between a shield of the cable in the cable receiving area, and a shield contact element in the plug tip.

2. The housing according to claim 1, wherein the partition opening is arranged in substantially the middle of the partition wall.

3. The housing according to claim 1, wherein the gap opening is disposed along an edge of the partition wall.

4. The housing according to claim 1, wherein the plug tip and the cable receiving area are disposed on opposing sides of the housing, the partition wall is disposed substantially perpendicularly to a plug-in direction in which the plug may be connected with a plug receptacle, and the partition wall is disposed substantially perpendicularly to a direction in which the cable may be introduced into the housing.

5. The housing according to claim 1, wherein the cable receiving area comprises a cable recess having a cable receiving area wall.

6. The housing according to claim 5, further comprising:

an insulating sleeve disposed in the cable recess and connected to the partition wall;

wherein the insulating sleeve and the partition opening form a channel for accommodating the inner conductor element.

7. The housing according to claim 5, the plug tip comprising:

a tip recess having a plug tip wall.

8. The housing according to claim 7, wherein the cable receiving area wall and the plug tip wall are aligned.

9. The housing according to claim 1, further comprising:

a shield contact element comprising a first portion disposed in the cable receiving area and a second portion that extends through the gap opening into the plug tip.

10. The housing according to claim 9, the shield contact element further comprising:

a contact spring disposed in the first portion.

11. The housing according to claim 9, further comprising:

a substantially cylindrical cable receiving area wall defined by the cable receiving area; and a substantially cylindrical plug tip wall defined by the plug tip;

wherein the shield contact element contacts at least one of the cable receiving area wall and the plug tip wall.

12. The housing according to claim 9, further comprising:

a plurality of contacts that are short-circuited when the plug is connected with a receptacle in the intended manner, wherein the short circuit is canceled on separation of the plug from the receptacle before the plug and the receptacle are completely separated from one another electrically.

13. A plug, comprising:

a cable recess adapted to receive a signal cable;

a plurality of contacts that are electrically connected to each other when the plug is connected with a receptacle in an intended manner;

at least one shell adapted for connection with the signal cable; and at least one pin connecting to each contact, each pin substantially surrounded by one shell and adapted for electrical connection with the signal cable, the electrical connection between the plurality of contacts depends upon the electrical connection between one pin and one signal cable which further connects to a control means that controls the transmission of electrical power through the signal cable;

wherein the plurality of contacts are electrically disconnected from each other before the plug and the receptacle are completely electrically separated from one another.

14. The plug according to claim 13, wherein the plurality of contacts are strip-form contacts arranged parallel to one another and parallel to a plug-in direction.

15. The plug according to claim 13, wherein one of the plurality of contacts is electrically connected with the pin.

16. The plug according to claim 15, wherein the one of the plurality of contacts is integrally formed with the pin.

17. The plug according to claim 13, further comprising:

a pin cap that surrounds the pin and prevents the ingress of foreign matter into the plug at the pin.

18. The plug according to claim 17, further comprising:

a sealing element associated with the pin cap.

19. The plug according to claim 17, further comprising:

a catch element associated with the pin cap, the catch element being adapted to lock the pin cap to the signal cable.

* * * * *